US006461069B1

(12) United States Patent
Williams

(10) Patent No.: US 6,461,069 B1
(45) Date of Patent: Oct. 8, 2002

(54) ABSORBENT SOAP-CONTAINING DEVICE

(76) Inventor: Carrie Williams, 712 E. Gunhill Rd., Apt. 2E, Bronx, NY (US) 10467

( * ) Notice: Subject to any disclaimer, the term of this patent is extended or adjusted under 35 U.S.C. 154(b) by 0 days.

(21) Appl. No.: 09/770,440

(22) Filed: Jan. 26, 2001

(51) Int. Cl.[7] ..... B43K 8/10
(52) U.S. Cl. ..... 401/201; 15/244.1
(58) Field of Search ..... 401/200, 201, 401/196; 15/244.1, 244.2, 244.3, 244.4

(56) References Cited

U.S. PATENT DOCUMENTS 1,756,713 A 4/1930 Vernet
2,032,762 A 3/1936 Mitchell
3,601,493 A 8/1971 Levy
4,344,529 A 8/1982 Ibarzabal
4,422,546 A 12/1983 Charity
4,510,641 A * 4/1985 Morris ..... 15/118
D367,986 S 3/1996 Haley et al.

* cited by examiner

*Primary Examiner*—Timothy L. Maust
*Assistant Examiner*—Peter deVore

(57) ABSTRACT

An absorbent soap-containing device for holding and using soap without making a mess. The absorbent soap-containing device includes a container including a dome-shaped shell member having an open bottom and also having a compartment therein, and also including a bowl-shaped shell member having an open top and a compartment therein with the shell members being closable and fastenable upon one another and being adapted to store solid soap in the compartments thereof.

4 Claims, 1 Drawing Sheet

ABSORBENT SOAP-CONTAINING DEVICE

BACKGROUND OF THE INVENTION

1. Field of the Invention

The present invention relates to a soap container and more particularly pertains to a new absorbent soap-containing device for holding and using soap without making a mess.

2. Description of the Prior Art

The use of a soap container is known in the prior art. More specifically, a soap container heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 2,032,762; 3,601,493; 4,422,546; 1,756,713; 4,344,529; and U.S. Pat. No. Des. 367,986.

While these devices fulfill their respective, particular objectives and requirements, the aforementioned patents do not disclose a new absorbent soap-containing device. The inventive device includes a container including a dome-shaped shell member having an open bottom and also having a compartment therein, and also including a bowl-shaped shell member having an open top and a compartment therein with the shell members being closable and fastenable upon one another and being adapted to store solid soap in the compartments thereof.

In these respects, the absorbent soap-containing device according to the present invention substantially departs from the conventional concepts and designs of the prior art, and in so doing provides an apparatus primarily developed for the purpose of holding and using soap without making a mess.

SUMMARY OF THE INVENTION

In view of the foregoing disadvantages inherent in the known types of soap container now present in the prior art, the present invention provides a new absorbent soap-containing device construction wherein the same can be utilized for holding and using soap without making a mess.

The general purpose of the present invention, which will be described subsequently in greater detail, is to provide a new absorbent soap-containing device which has many of the advantages of the soap container mentioned heretofore and many novel features that result in a new absorbent soap-containing device which is not anticipated, rendered obvious, suggested, or even implied by any of the prior art soap container, either alone or in any combination thereof.

To attain this, the present invention generally comprises a container including a dome-shaped shell member having an open bottom and also having a compartment therein, and also including a bowl-shaped shell member having an open top and a compartment therein with the shell members being closable and fastenable upon one another and being adapted to store solid soap in the compartments thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new absorbent soap-containing device which has many of the advantages of the soap container mentioned heretofore and many novel features that result in a new absorbent soap-containing device which is not anticipated, rendered obvious, suggested, or even implied by any of the prior art soap container, either alone or in any combination thereof.

It is another object of the present invention to provide a new absorbent soap-containing device which may be easily and efficiently manufactured and marketed.

It is a further object of the present invention to provide a new absorbent soap-containing device which is of a durable and reliable construction.

An even further object of the present invention is to provide a new absorbent soap-containing device which is susceptible of a low cost of manufacture with regard to both materials and labor, and which accordingly is then susceptible of low prices of sale to the consuming public, thereby making such absorbent soap-containing device economically available to the buying public.

Still yet another object of the present invention is to provide a new absorbent soap-containing device which provides in the apparatuses and methods of the prior art some of the advantages thereof, while simultaneously overcoming some of the disadvantages normally associated therewith.

Still another object of the present invention is to provide a new absorbent soap-containing device for holding and using soap without making a mess.

Yet another object of the present invention is to provide a new absorbent soap-containing device which includes a container including a dome-shaped shell member having an open bottom and also having a compartment therein, and also including a bowl-shaped shell member having an open top and a compartment therein with the shell members being closable and fastenable upon one another and being adapted to store solid soap in the compartments thereof.

Still yet another object of the present invention is to provide a new absorbent soap-containing device that economically uses up all of the solid soap even when it becomes impractical to use the strips of soap.

Even still another object of the present invention is to provide a new absorbent soap-containing device that allows the user to save money.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
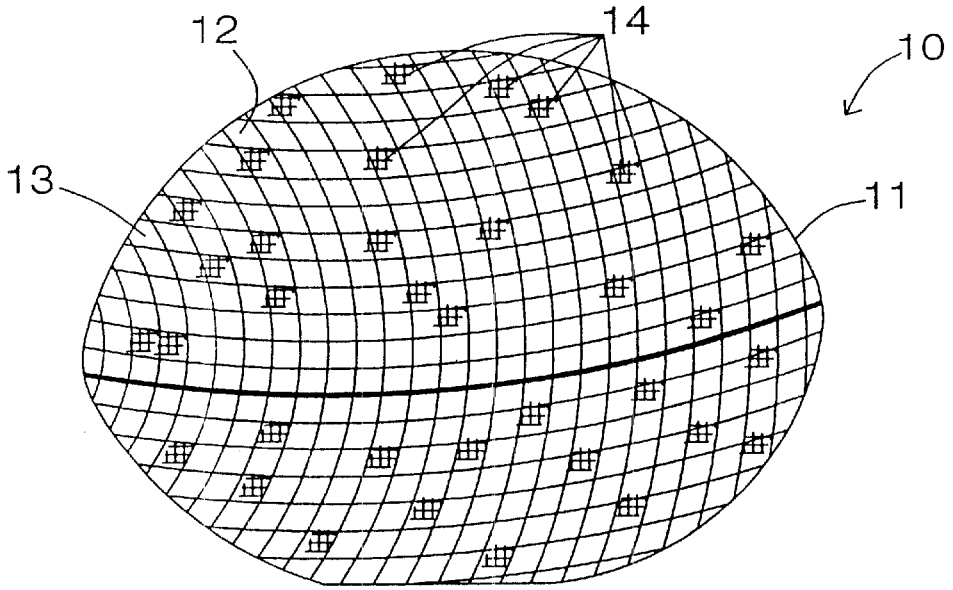
FIG. 1 is a perspective view of a new absorbent soap-containing device according to the present invention.
Figure 2:
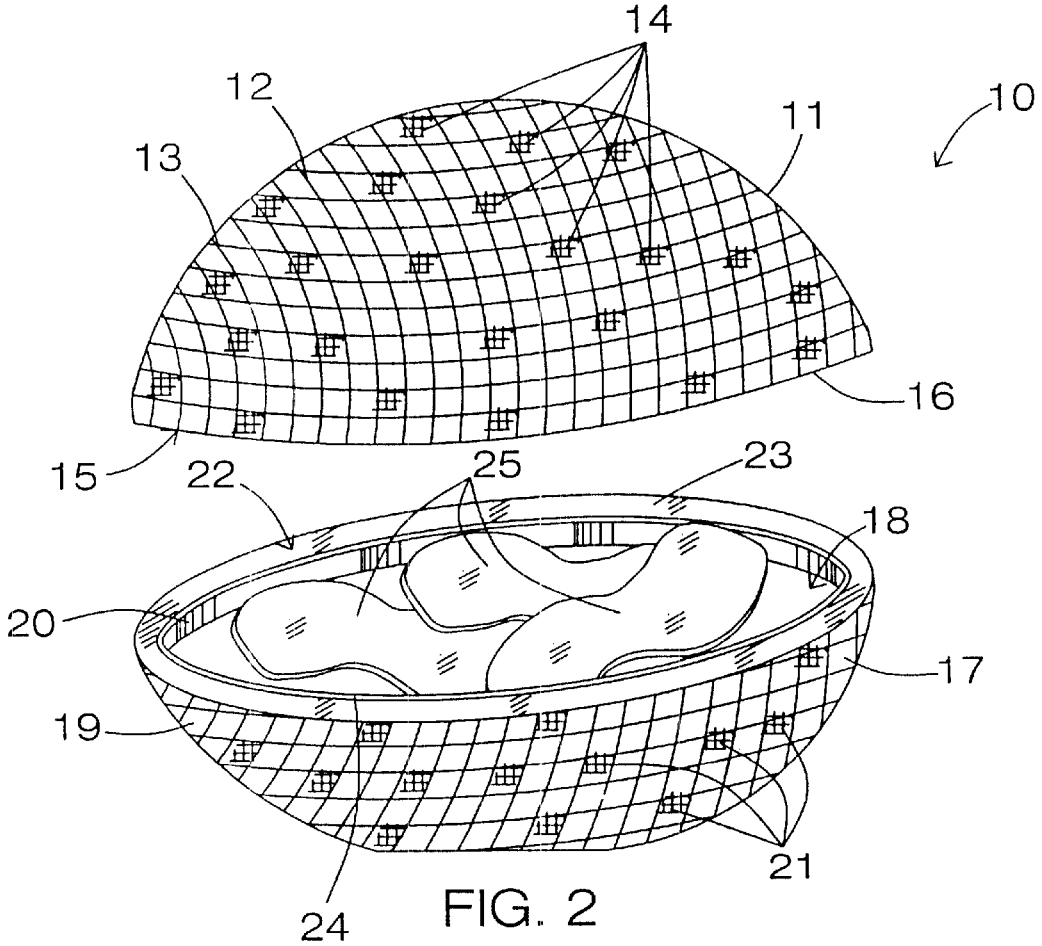
FIG. 2 is an exploded perspective view of the present invention.

With reference now to the drawings, and in particular to FIGS. 1 through 2 thereof, a new absorbent soap-containing device embodying the principles and concepts of the present invention and generally designated by the reference numeral 10 will be described.

As best illustrated in FIGS. 1 through 2, the absorbent soap-containing device 10 generally comprises a container 11 including a dome-shaped shell member 12 having an open bottom 15 and also having a compartment therein, and also including a bowl-shaped shell member 17 having an open top 22 and a compartment 18 therein. The shell members 12,17 are conventionally closable and fastenable upon one another and are adapted to store solid soap 25 in the compartments 18 thereof. The shell members 12,17 are made of soft spongy material with a plurality of pores 14,21 being spaced about and being extended therethrough to allow liquefied soap to pass through the pores 14,21 from in the compartments 18. The soft spongy material has a definite thickness. Each of the shell members 12,17 also has an outer side 13,19 and an inner side 20 which forms a respective compartment 18. The dome-shaped shell member 12 has a rim 16 at the open bottom 15 thereof, and the bowl-shaped shell member 17 has a rim 23 at the open top 22 thereof. Each of the shell members 12,17 has a raised annular ridge 24 being conventionally disposed upon a rim 16,23 thereof and is mateable with the raised annular ridge of the other the shell member 12,17 to effectively fasten the shell members 12,17 together to form a globe-shaped member.

In use, the user opens the container 11 and places strips of solid soap in the compartments 18 of the shell member 12,17, and then closes the container 11. As the user cleanses oneself with the container 11, the spongy material soaks up water and the solid soap in the container 11 becomes liquefied and seeps through the pores 14,21 of the shell members 12,17 so that the user can rub the soap upon one's body using the soft container 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An absorbent soap-containing device comprising:

a container including a first shell portion and a second shell portion, each of said shell portions having a convex outer side and a concave inner side forming a recess therein, each of said shell portions having a perimeter rim extending between said outer and inner sides of the shell portion, the perimeter rims of said shell portions being abuttable together to form a shell such that the recesses of said shell portions are in communication for receiving soap pieces therein, and fastening means being formed on the perimeter rims of said shell portions for removably fastening the perimeter rims of said shell portions together to form a closed interior.

2. An absorbent soap-containing device as described in claim 1, wherein said shell portions are made of soft spongy material with a plurality of pores being spaced about and extending therethrough to allow liquefied soap to pass through said pores from said recesses, said soft spongy material having a thickness.

3. An absorbent soap-containing device as described in claim 1, wherein said fastening means comprises a raised annular ridge being disposed upon the perimeter rim of each of said shell portion, said raised annular ridge of one said shell portion being mateable with said raised annular ridge of the other said shell portions to effectively fasten said shell portions together to form a globe member.

4. An absorbent soap-containing device comprising:

a container including a first shell portion and a second shell portion, each of said shell portions having a convex outer side and a concave inner side forming a recess therein, each of said shell portions having a perimeter rim extending between said outer and inner sides of the shell portion, the perimeter rims of said shell portions being abuttable together to form a shell such that the recesses of said shell portions are in communication for receiving soap pieces therein, and fastening means being formed on the perimeter rims of said shell portions for removably fastening the perimeter rims of said shell portions together to form a closed interior;

wherein said shell portions are made of soft spongy material with a plurality of pores being spaced about and extending therethrough to allow liquefied soap to pass through said pores from said recesses, said soft spongy material having a thickness; and wherein said fastening means comprises a raised annular ridge being disposed upon the perimeter rim of each of said shell portion, said raised annular ridge of one said shell portion being mateable with said raised annular ridge of the other said shell portions to effectively fasten said shell portions together to form a globe member.

* * * * *